US006439472B1

(12) United States Patent
Lin et al.

(10) Patent No.: US 6,439,472 B1
(45) Date of Patent: Aug. 27, 2002

(54) SPRAYER DEVICE HAVING A LIGHT OR WARNING DEVICE

(75) Inventors: Yen Tang Lin, Taichung (TW); Bi Guang Tsai, No. 14, Lane 69, Sec. 4, Tien Gin Road, Taichung (TW), 406

(73) Assignee: Bi Guang Tsai, Taichung (TW)

( * ) Notice: Subject to any disclaimer, the term of this patent is extended or adjusted under 35 U.S.C. 154(b) by 0 days.

(21) Appl. No.: 09/861,454

(22) Filed: May 17, 2001

(51) Int. Cl.[7] ..... B05B 17/08; F21S 8/00

(52) U.S. Cl. ..... 239/18; 239/16; 239/17; 239/71; 239/75; 239/548

(58) Field of Search ..... 239/16, 17, 18, 239/71, 75, 548; 4/615

(56) References Cited

U.S. PATENT DOCUMENTS 4,564,889 A * 1/1986 Bolson ..... 290/54
4,616,298 A * 10/1986 Bolson ..... 290/54
6,021,960 A * 2/2000 Kehat ..... 239/18

FOREIGN PATENT DOCUMENTS

JP 363158373 * 7/1988

* cited by examiner

*Primary Examiner*—Robin O. Evans

(57) ABSTRACT

A sprayer device may receive water from a water reservoir, and includes a light device, and a device for actuating the light device with the water flowing through the sprayer device. The light device may be energized to light the mist or the spraying water out of the sprayer device for decorative purposes. The sprayer device includes a barrel coupled to the water reservoir. A switch device includes two conductor blades disposed in the barrel and coupled to the light device for being actuated by the water flowing through the barrel.

3 Claims, 3 Drawing Sheets

SPRAYER DEVICE HAVING A LIGHT OR WARNING DEVICE

BACKGROUND OF THE INVENTION

1. Field of the Invention

The present invention relates to a sprayer device, and more particularly to a sprayer device having a light device for decorative purposes or a warning device for indicating the hot water that has a temperature over the endurable temperature range.

2. Description of the Prior Art

Various kinds of typical sprayer devices, such as the sprayer guns, the spray nozzles, the sprinklers, the shower heads etc. have been widely used today. However, none of the sprayer device provide a light device for decorative purposes or a warning device for indicating the hot water that has a temperature over the endurable temperature range.

The present invention has arisen to mitigate and/or obviate the afore-described disadvantages of the conventional sprayer devices.

SUMMARY OF THE INVENTION

The primary objective of the present invention is to provide a sprayer device including a light device for decorative purposes or a warning device for indicating the hot water that has a temperature over the endurable temperature range.

In accordance with one aspect of the invention, there is provided a sprayer device comprising a sprayer body coupled to a water reservoir for receiving water from the water reservoir, a light device, and a water actuating means for actuating the light device with the water from the water reservoir. The light device may thus be actuated and energized by the water flowing through the sprayer body and may thus be used to light the mist or the spraying water out of the sprayer body for decorative purposes.

The sprayer body includes a barrel coupled to the water reservoir for receiving the water from the water reservoir, the water actuating means includes a switch device disposed in the barrel and coupled to the light device for being actuated by the water flowing through the barrel.

The barrel includes an opening formed therein for receiving the switch device. The switch device includes two spring blades engaged into the barrel for being actuated by the water flowing through the barrel.

A device is further provided for energizing the light device when detecting an over-heated water, and includes a water temperature sensor engaged into the barrel and electrically coupled to the light device for energizing the light device when the water temperature sensor detects the over-heated water.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
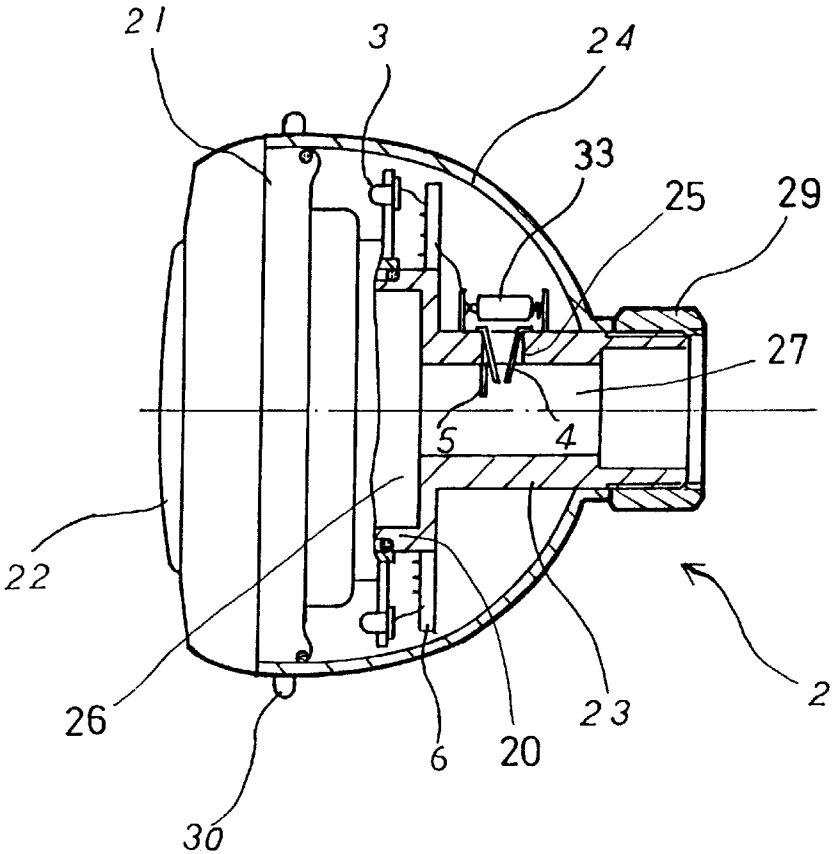
FIG. 1 is a partial cross sectional view of a sprayer device in accordance with the present invention.
Figure 2:
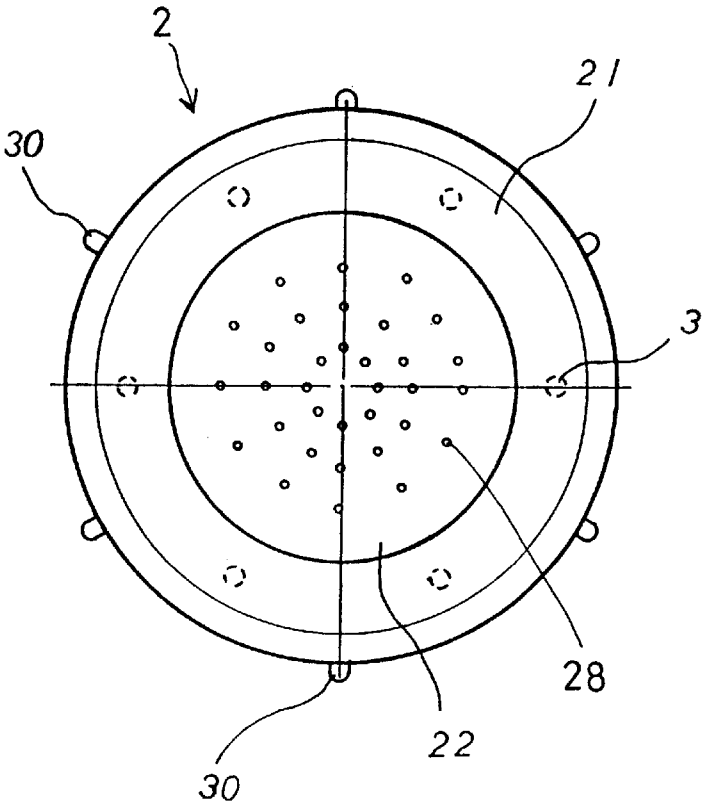
FIG. 2 is a front view of the sprayer device.
Figure 3:
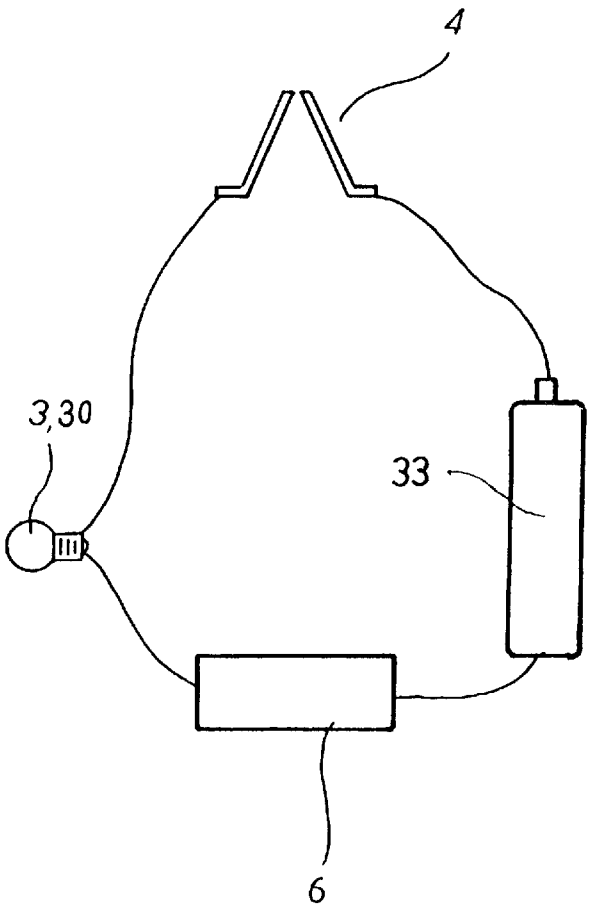
FIG. 3 is a schematic view showing the electric circuit of the sprayer device.

Referring to the drawings, and initially to FIGS. 1–3, a sprayer device in accordance with the present invention, such as a sprayer nozzle or a shower head, comprises a sprayer body 2 including a casing 20 received in an outer housing 24 and having a chamber 26 formed therein, and having a barrel 23 extended rearwardly therefrom and having an inner diameter smaller than that of the casing 20 and having a bore 27 formed therein. The barrel 23 may be directly coupled to the water reservoir with a lock nut 29 or the like, or may be indirectly coupled to the water reservoir via a hose 7 (FIG. 5) or a pivotal joint 9 (FIG. 4), with the lock nut 29 or the like, for receiving the water 83 from the water reservoir. The pivotal joint 9 includes a passage 91 formed therein (FIG. 4) for communicating the barrel 23 with the water reservoir and for receiving the water 83 from the water reservoir.

The barrel 23 may be secured in the rear portion of the outer housing 24 for securing and retaining the casing 20 within the housing 24. A cover 21 and a plate 22 may be secured to the front portion of the housing 24, and/or of the casing 20, and are preferably made of transparent materials, such as the transparent plastic or acrylic or glass materials. The plate 22 includes a number of orifices 28 formed therein (FIG. 2) for allowing the water to flow out through the orifices 28 of the plate 22.

A circuit board 6 is secured in the housing 24 and disposed on the outer portion of the casing 20, and may include a processor unit or an integrated circuit or the like attached thereon. One or more light bulbs 3, 30 are electrically coupled to the circuit board 6, in which the light bulbs 3 are disposed in the housing 24 and on the outer portion of the casing 20, and the other light devices 30 are disposed on the outer portion of the housing 24. One or more batteries 33 may be coupled to the circuit board 6 for energizing the electrical elements. A switch device 4, such as two spring or conductive blades 4, is coupled to the batteries 33 and the light devices 3, 30 respectively and partially engaged into the bore 27 of the barrel 23 via an opening 25 of the barrel 25. A probe or a temperature sensor 5 may further be provided and coupled to the circuit board 6 and is partially engaged into the bore 27 of the barrel 23 via an opening 25 of the barrel 23.

Figure 4:
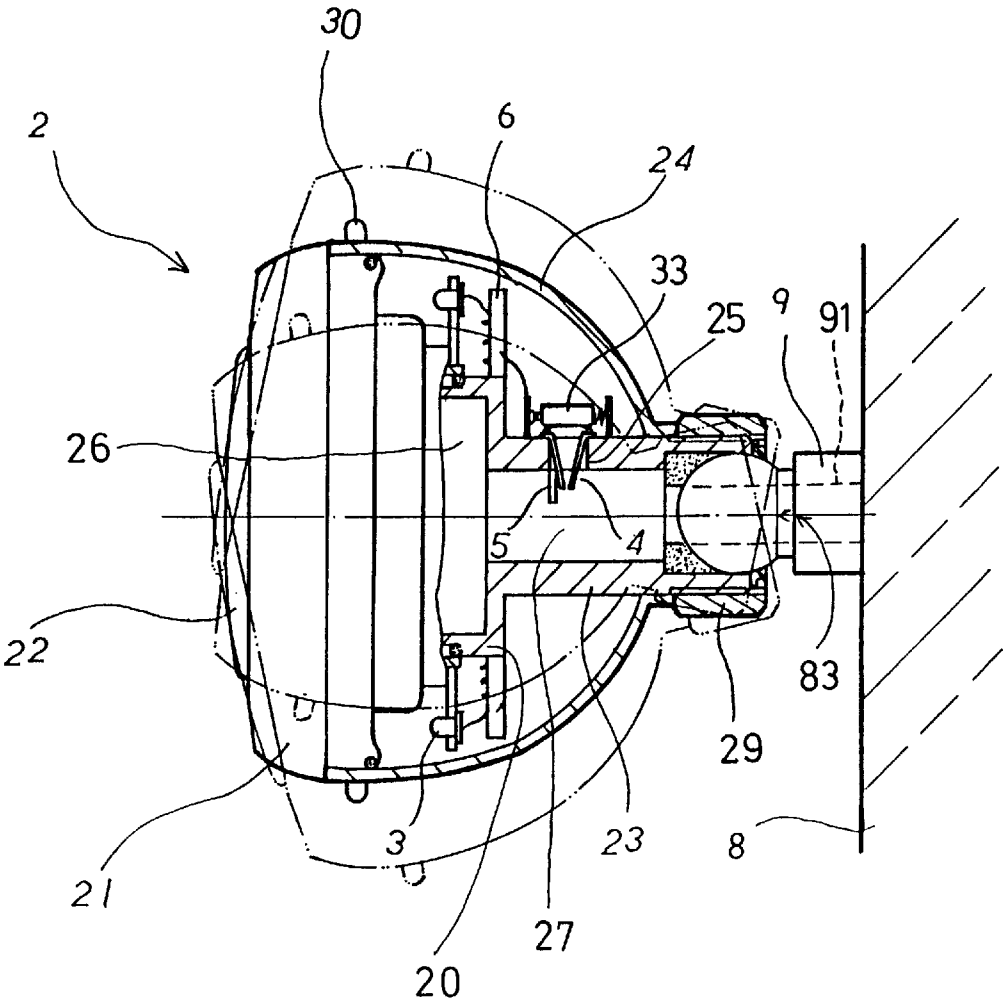
FIGS. 4, 5 are partial cross sectional views similar to FIG. 1, illustrating the operation of the sprayer device.
Figure 5:
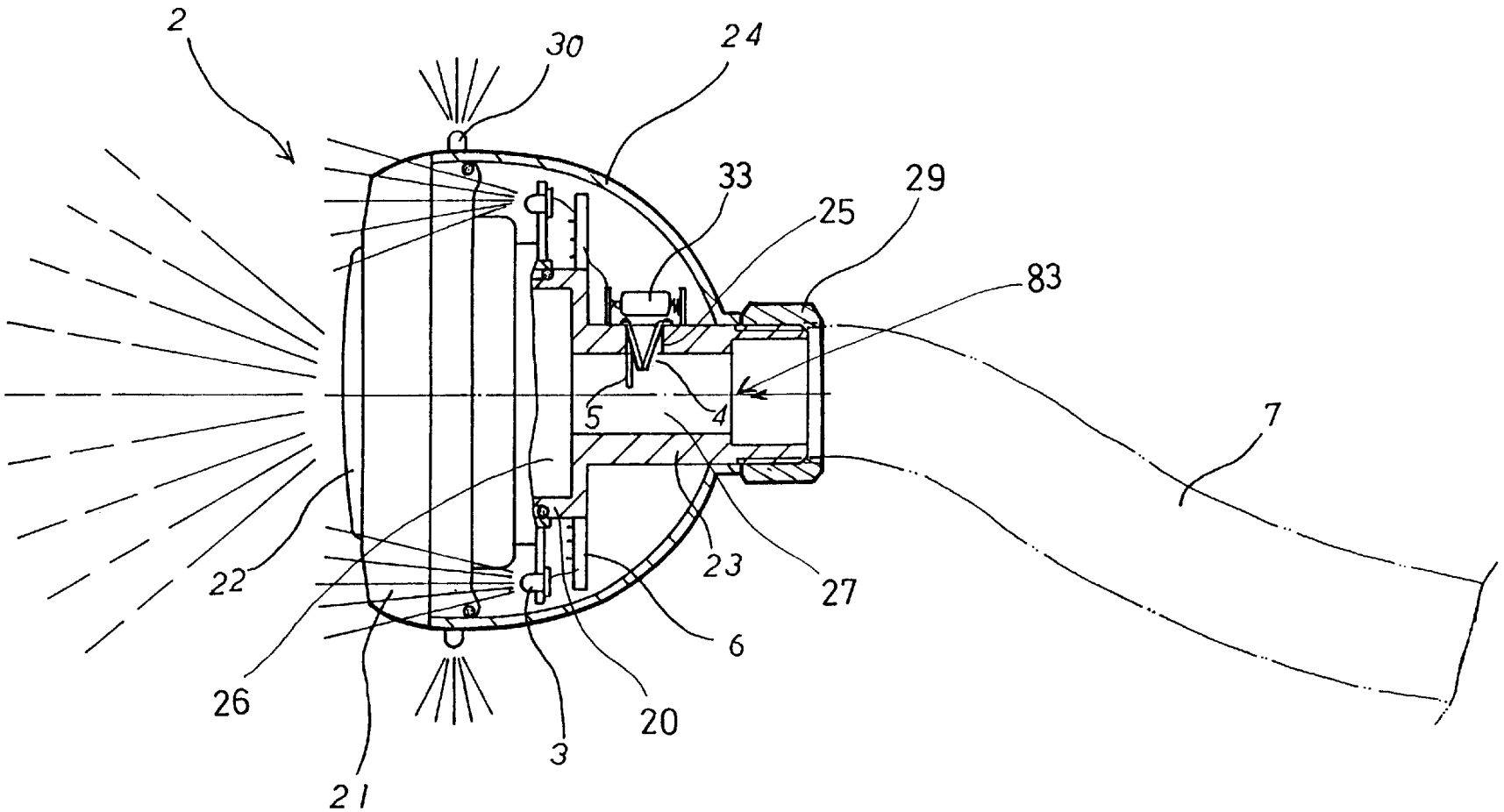

In operation, as shown in FIGS. 4 and 5, when water flows through the bore 27 of the barrel 23 and the chamber 26 of the casing 20, the conductor blades 4 may be forced to contact with each other in order to close the electric circuit and in order to energize the light bulbs 3, 30. The light emitted by the light bulbs 3, 30 may shine onto the mist or the spraying water flowing out of the orifices 28 of the plate 22, for decorative purposes. When the water flowing through the water temperature sensor 5 is over-heated or includes a temperature over the endurable temperature range, the water temperature sensor 5 may send out a signal to the processor unit of the circuit board 6 in order to actuate or to energize or to flash the light bulbs 3, 30 in order to warn the users that the water is over-heated.

A sealing member or a pad or the like may be engaged into the opening 25 of the barrel 23 for blocking the water and for preventing the water from flowing into the space formed between the casing 20 and the housing 24. The conductor blades 4 may be replaced by the coil springs or the like for allowing the conductor blades 4 to be contacted with each other and to be actuated by the flowing water.

Alternatively, the light devices 3 may be actuated by the switch device or the conductor blades 4 and by the water flowing through the bore 27 of the barrel 23; and the other light bulbs 30 may preferably be actuated by the water temperature sensor 5 when an over-heated has been detected.

Accordingly, the sprayer device in accordance with the present invention includes a light device for decorative purposes or a warning device for indicating the hot water that has a temperature over the endurable temperature range.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

We claim:

1. A sprayer device comprising:

a sprayer body coupled to a water reservoir for receiving water from the water reservoir, means for generating a warning signal when an over-heated water is detected, said warning signal generating means including a water temperature sensor engaged into said sprayer body for detecting water temperature of the water, and including a light device coupled to said water temperature sensor for being actuated by said water temperature sensor, and a water actuating means for actuating said light device with the water from the water reservoir.

2. The sprayer device according to claim 1, wherein said sprayer body includes a barrel coupled to the water reservoir for receiving the water from the water reservoir, said water actuating means includes a switch device disposed in said barrel and coupled to said light device for being actuated by the water flowing through said barrel.

3. The sprayer device according to claim 2, wherein said switch device includes two spring blades engaged into said barrel for being actuated by the water flowing through said barrel.

* * * * *